United States Patent [19]

Bordas et al.

[11] 4,265,097

[45] May 5, 1981

[54] CLOSET FOR THE CONSERVATION OF WINE IN BOTTLES OR OTHER FOODSTUFFS

[76] Inventors: Robert Bordas, St. Jean de Maurienne; Paul Lacharmoise, Neuilly-sur-Seine; Gilbert Moteruil, Plaisir, all of France

[21] Appl. No.: 67,002

[22] Filed: Aug. 16, 1979

[30] Foreign Application Priority Data

Aug. 16, 1978 [FR] France ..... 78 23835

[51] Int. Cl.[3] ..... F25D 11/04

[52] U.S. Cl. ..... 62/438; 62/91

[58] Field of Search ..... 62/430, 438, 91

[56] References Cited

U.S. PATENT DOCUMENTS

| | | | |
|---|---|---|---|
| 1,230,692 | 6/1917 | Eweu et al. | 62/438 |
| 1,806,019 | 5/1931 | Muffly | 62/438 |
| 1,924,117 | 8/1933 | Fritz et al. | 62/89 |
| 1,928,580 | 9/1933 | Warner | 62/95 |
| 1,940,192 | 12/1933 | Sorber | 62/430 |
| 2,139,441 | 12/1938 | Clarke | 62/89 |
| 2,241,411 | 5/1941 | McGuffey | 62/430 |
| 2,513,610 | 7/1950 | Williams | 62/430 |
| 2,722,809 | 11/1955 | Morrison | 62/116 |

FOREIGN PATENT DOCUMENTS

| | | | |
|---|---|---|---|
| 2136320 | 2/1973 | Fed. Rep. of Germany . | |
| 1248492 | 11/1960 | France | 62/430 |
| 1583923 | 12/1969 | France . | |
| 1599044 | 4/1970 | France . | |

*Primary Examiner*—Ronald C. Capossela

*Attorney, Agent, or Firm*—Brumbaugh, Graves, Donohue & Raymond

[57] ABSTRACT

Closet for the conservation of goods such as wine in bottles or other foodstuffs.

The body 10 of the closet is refrigerated. Internally applying against the walls, 13, 14, 15 of the closet, is a U-shaped vat filled with an aqueous solution. This vat is open at its upper end.

A serpentine evaporator 17 refrigerates the solution in the vat, without freezing it.

The aqueous solution defines the coolest zones of the interior of the closet, ensures constancy of temperature in time, and controls the internal hygrometry.

5 Claims, 5 Drawing Figures

CLOSET FOR THE CONSERVATION OF WINE IN BOTTLES OR OTHER FOODSTUFFS

The invention relates to closets intended for the conservation of goods such as wine, cheese or other foodstuffs requiring the atmosphere of a cellar.

It is admitted that to obtain a perfect conservation, and even an improvement in the quality and taste of goods such as wine in bottles, cheese or the like, said goods must be stocked in places responding to the following conditions: constant temperature (around 10° C.), darkness, high and constant rate of humidity, and absence of vibrations.

Places responding to these conditions become the more and the more rare. One may still find them in ancient cellars, but cellars of modern buildings (when they exist) do not respond to these conditions and therefore do not allow a satisfactory conservation of the goods concerned.

Furthermore, the idea of keeping cheese or wine up to maturity is thoroughly excluded, thus forcing the consumer to purchase expensive products having already a satisfactory degree of maturity and consume them immediately.

To solve this problem, a certain number of home closets for the conservation of perishable goods have been proposed. But such devices are in general intended for the conservation of goods which it is desirable to expose to extremely low temperatures (like the one disclosed, for instance, in U.S. Pat. No. 1,928,580), while it is generally admitted that very low temperatures are fatal for both cheese and wine.

French Patents No. 1.599.044 and No. 1.583.923, as well as German Pat. No. 2.136.320 disclose precincts where wine in bottles could be kept under conditions of controlled temperature, and in a moist atmosphere. But these devices do not protect the goods stocked therein from thermical shocks resulting from the opening of the access door; furthermore, both devices are energy-consuming, since the refrigerative group must be working almost all the time because of the thermical leaking. This leads to a high level of vibration. Otherwise, if the rate of humidity is, as required, high, it is not satisfactorily controlled.

U.S. Pat. Nos. 1,924,117 and No. 2,139,441 disclose an improvment consisting in the association of such devices with a completely closed reservoir of cooling fluid which provides for a better degree of thermical inertia. But these devices are intended for very different purposes, and do not solve the problem of the control of the rate of humidity in the refrigerated precinct.

U.S. Pat. No. 2,722,809 discloses a refrigerated room associated with moistening means. But this device is clearly not suitable for goods like cheese and wine, the thermical inertia being insufficient, and no solution being proposed to the problem of control of excess moisture which may deteriorate, for instance, the corks of the bottles.

The present invention provides for a closet intended for the conservation of perishable goods such as wine in bottles or cheese, wherein a satisfactory thermical inertia is obtained through means which, at the same time, ensure a simple, inexpensive and constant control of the rate of humidity.

A closet according to the invention comprises a well-known insulated box, associated to an also well-known refrigerative group, the evaporator of which is immerged in an aquous solution contained in a vat situated internally around the walls of the box, the upper part of said vat communicating through at least one opening of appropriate size with the interior of the box, where bottle racks or other appropriate supports lie on shock-absorbing means, and are laterally attached to the vat also through shock-absorbing means.

In one embodiment of the invention, the vat extending around the three vertical walls of a parallelepipedic box is left open at its upper end, said upper end being itself situated at a certain distance, for instance, 5 cm, from the ceiling of the box.

In another embodiment of the invention, the vat is associated to a dish-form horizontal bottom element resting on the floor of the box, a bed of dry sand or the like being laid on said element to absorb the water condensed on the cooling walls.

According to the invention, the great surface of the cooling walls ensures a temperature almost constant in space within the box. The great thermical inertia resulting from the presence of water in the vat ensures the constancy of temperature in time; and, most advantageously, the hygrometry is controlled by the same constancy of temperature of the water (cool but not frozen) in the open vat, acting as water-vapour source within the box.

Concerning the constancy of temperature in time, the importance of the mass of water in the vat ensures a great thermical inertia, thus allowing a reduction of the frequency of operativeness of the group. This reduces vibrations, saves energy, and extends the life of the group itself, maintaining nevertheless the temperature within the box at an almost constant level.

By way of example, in a box containing 380 liters (0.5 Kg) of air, if only a variation of temperature of 0.5° C. is tolerated, a thermical leaking of 5 Kcal/hour will cause, for a temperature of 12° C., the refrigerative group to become operative each 2.5 minutes. Indeed, the variation of internal energy of 0.5 Kg of air between 11.5° C. and 12° C. being around 0.2 Kcal, a leaking of 5 Kcal/hour will cause a variation of temperature of 0.5° C. in about 1/25 of an hour, that is, about 2 minutes and a half.

Conversely, with a mass of 30 Kg of water in the vat around the walls of the box, the thermical inertia increases substantially (15 Kcal for a variation of 0.5° C.), so that with the same leaking of 5 Kcal/hour, the temperature remains within the tolerated limits for about 3 hours.

Concerning the control of hygrometry, the open vat and the cool but not frozen solution therein define the most cool zones of the box, and therefore the pressure of saturating vapour in said box.

By way of example, if the temperature within the box is 12° C. (with variations not greater than 1° C.), with a temperature of cooling walls (and solution) of 9.5° C., the pressure of saturating vapour being at 9.5° C. around 0.85 of that of 12° C., the relative hygrometry stabilizes at around 85%.

Further characteristics and advantages of the invention will appear from the following description of one preferred embodiment, given by way of example, and with reference to the attached drawings, wherein.

Figure 1:
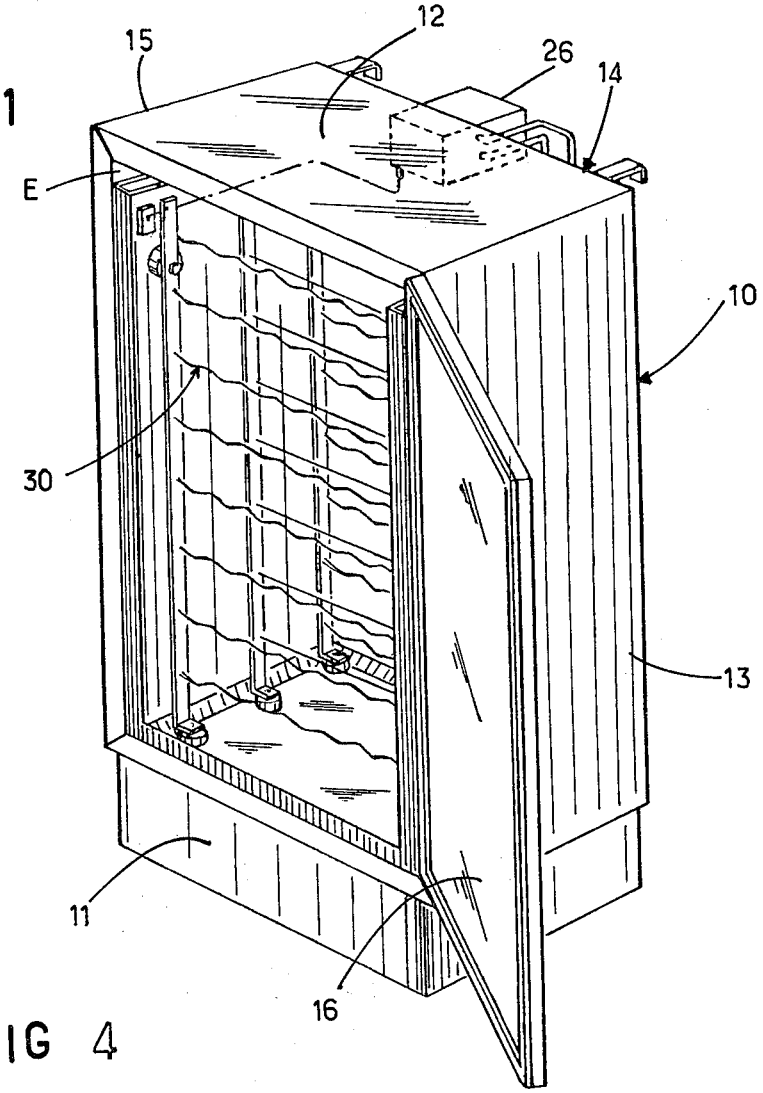
FIG. 1 is a prospective view of a closet according to the invention.
Figure 4:
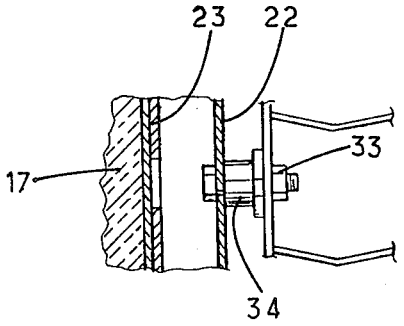
FIG. 4 and FIG. 5 show in detail the shock-absorbing means for a bottle rack within the closet.

According to this embodiment, the closet comprises a parallelepipedic body 10, with a bottom 11, an upper wall or ceiling 12, side walls 13, 14 and 15, and a front door 16. Each of the walls and the door are internally plated with an appropriate insulating material 17.

Figure 3:
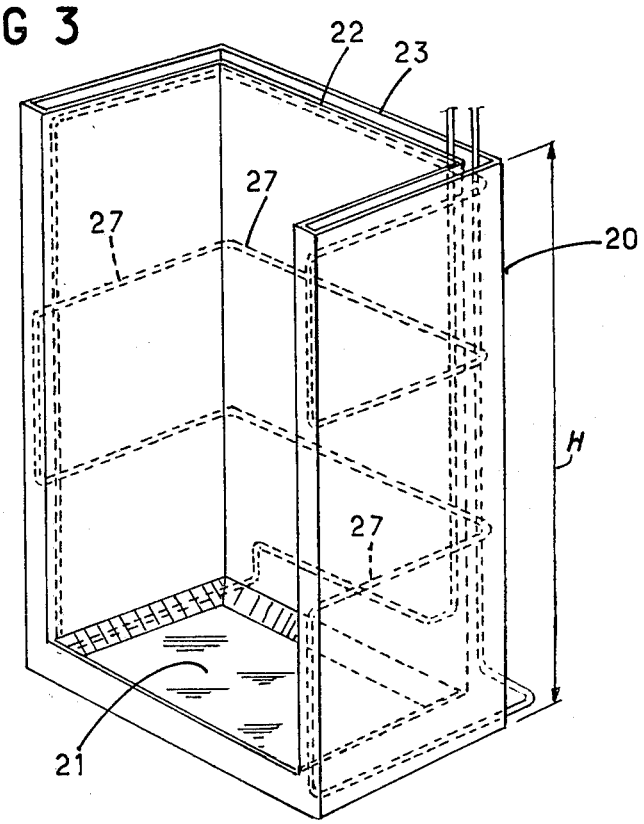
FIG. 3 is a prospective view of the vat.

Within the box thus defined is situated a vat, globally indicated with reference 20 in FIG. 3. The vat 20 has a general U-shape in cross-section, and is constituted by a bottom 21, advantageously presenting the form of a dish, and double walls 22, 23.

The vat 20 thus formed lies by its dish-like bottom 21 on the floor of the box, while the external walls 23 are against the corresponding insulated vertical walls 13, 14, 15 of the closet.

The upper end of the vat should present, between the walls 22,23, at least one opening of appropriate size. In the embodiment shown, the upper end of the vat is left free, the opening thus extending all along said upper end.

The vat 20 is, in height, (H in FIG. 3) some centimeters shorter than the corresponding vertical walls of the surrounding box, so that a space E (FIG. 1) exists between the upper end of the vat 20 and the ceiling 12 of the closet (FIG. 1) Through this space, the vat may be filled with water or an appropriate acquous solution; in one embodiment, the vat is filled with plain water almost up to its border.

When the vat is placed within the box, the internal walls 22 constitute the cooling surface.

The refrigerative group associated to the closet comprises a well-known compressor and condenser 26, the serpentine evaporator 27 of which is immerged in the acquous solution contained in the vat. The evaporator follows a continuous sinuous course all along the three panels of the vat, as shown in FIG. 3.

Figure 5:
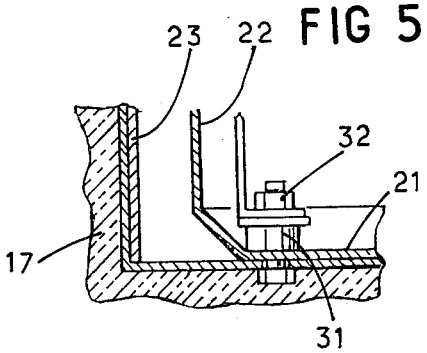
Figure 2:
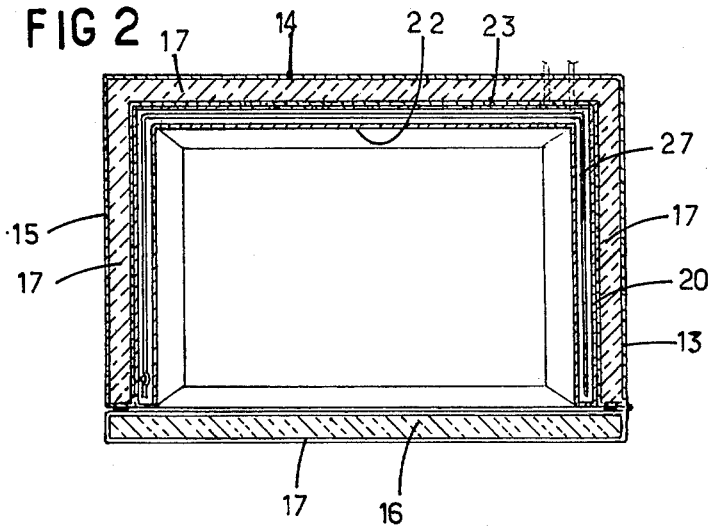
FIG. 2 is a cross-sectional horizontal view of the closet.

The internal arrangement of the closet (FIG. 1) comprises a bottle rack 30 lying on shock-absorbing means 31 (FIG. 5) to which it is attached through bolts 32; laterally, the bottle rack is attached to the vat 20 through bolts 33, with interposition of shock-absorbing means 34, said shock-absorbing means being advantageously soft rubber blocks. This structure constitutes a bar for the remainder of vibrations resulting from the functioning of the refrigerative group; a part of said vibrations may be absorbed before reaching the box through means as the ones disclosed, for instance, in French Pat. No. 1.583.923.

The dish-like bottom 21 of the vat may receive a bed of dry sand or the like to absorb the condensation waters of the cooling walls 22, thus recreating even more closely the atmosphere of a good cellar.

Of course, the internal arrangement of the closet could be different, with for example appropriate supports for cheese; it could also be arranged to stock other perishable goods requiring the same conditions.

The invention is otherwise not limited to the embodiment shown, but may be subject to modifications without stepping out of its framework.

We claim:

1. A closet for the conservation of foods such as wine in bottles, cheese or the like by maintaining said goods under conditions of constant high humidity and relatively low temperature above freezing comprising an insulated box having a top, a bottom, three vertical walls, and a door, a vat adapted to receive and retain water, the vat extending around the three verticle walls of the box and immediately adjacent thereto, and a refrigerative group comprising an evaporator, the evaporator being positioned within the vat so as to cool water therein, and the upper end of the vat presenting at least one opening to the interior of the box whereby moisture from the vat flows through said opening into the interior of the box for maintaining the desired constant high humidity therein.

2. A closet according to claim 1, wherein the upper end of the vat is open all along its periphery.

3. A closet according to claim 1, wherein the upper end of the vat is separated from the ceiling of the box by a given space.

4. A closet according to claim 1, wherein the space is about 5 cm.

5. The closet of claim 1, including support means for said foods, and shock-absorbing means intermediate the support means and the closet.

* * * * *